United States Patent [19]

Okamoto et al.

[11] Patent Number: 4,572,128

[45] Date of Patent: Feb. 25, 1986

[54] FUEL INJECTION CARBURETOR IN INTERNAL COMBUSTION ENGINE

[75] Inventors: Takamitsu Okamoto; Keisou Takeda, both of Sasono, Japan

[73] Assignee: Toyota Jidosha Kabushiki Kaisha, Aichi, Japan

[21] Appl. No.: 649,608

[22] Filed: Sep. 12, 1984

[30] Foreign Application Priority Data

Sep. 13, 1983 [JP] Japan ..... 58-141876[U]
Oct. 4, 1983 [JP] Japan ..... 58-153916[U]

[51] Int. Cl.[3] ..... F02M 3/00
[52] U.S. Cl. ..... 123/339; 123/470
[58] Field of Search ..... 123/470, 478, 339, 437, 123/438, 472

[56] References Cited

U.S. PATENT DOCUMENTS

| | | | |
|---|---|---|---|
| 4,212,277 | 7/1980 | Melotti | 123/472 |
| 4,235,375 | 11/1980 | Melotti | 123/470 |
| 4,337,742 | 7/1982 | Carlson et al. | 123/339 |
| 4,373,491 | 2/1983 | Knapp | 123/472 |
| 4,416,241 | 11/1983 | Knapp et al. | 123/470 |

FOREIGN PATENT DOCUMENTS

| | | | |
|---|---|---|---|
| 2928350 | 2/1981 | Fed. Rep. of Germany | 123/470 |
| 129256 | 8/1982 | Japan | 123/470 |
| 2027488 | 2/1980 | United Kingdom | 123/470 |

*Primary Examiner*—Magdalen Y. C. Moy
*Attorney, Agent, or Firm*—Parkhurst & Oliff

[57] ABSTRACT

A fuel injection carburetor in an internal combustion engine, comprising: a fuel injection valve provided at a position upstream of a throttle valve mounted in an intake passage; and an idling bypass air passage bypassing the throttle valve; wherein the range of fuel spray angle of the fuel injection valve is determined such that the fuel injection valve is disposed in such a manner that a position on the surface of the throttle valve, to which the sprayed fuel reaches, is always located at an opening forward end in the downstream direction of the throttle valve rather than an opening forward end in the upstream direction within the total throttle opening of the throttle valve from the full closing to the full opening, there are provided a bypass air valve of a wax-type provided in the idling bypass air passage and in which the higher the temperature rises, the less the flowing area of the bypass air passage is made, and a hot water passage for circulating the engine coolant from a position adjacent the opening forward end in the downstream direction of the throttle valve and through a wax portion of the bypass air valve of the wax-type, and an outlet of a bypass air passage for the idle adjustment to correct an air flow rate in the idling bypass air passage is provided on an inner wall of the intake passage on the side of the opening forward end in the upstream direction of the throttle valve.

24 Claims, 3 Drawing Figures

FUEL INJECTION CARBURETOR IN INTERNAL COMBUSTION ENGINE

BACKGROUND OF THE INVENTION

1. Field of the Invention

This invention relates to improvements in a fuel injection carburetor in an internal combustion engine.

2. Description of the Prior Art

Recently, as one of fuel injection devices used in engines of motor vehicles, each of which is controlled by an electronic controller comprising a microcomputer, there has been known a fuel injection carburetor, which is a so-called single point injector, wherein a fuel injection valve is provided in an intake passage in a throttle body portion upstream of an intake manifold and fuel is injected at a portion upstream of a throttle valve provided in the throttle body.

In the case of the engine using the aforesaid fuel injection carburetor, in order to stabilize the idling operation of the engine, an idling bypass air passage is provided for leading air from an upstream portion of the throttle valve to a downstream portion thereof, bypassing the throttle valve.

In this case, when the engine is low in temperature, the atomization of fuel injected from the fuel injection valve is unsatisfactory. In consequence, it is necessary to supply a sufficient flow rate of bypass air from the bypass air passage and obtain a satisfactory air-fuel mixture.

Furthermore, the sliding friction is high in the engine when the temperature is low. Consequently, in order to stabilize the idle rotation, it is necessary to supply a required and sufficient flow rate of air to the engine.

Therefore, the higher the temperature of the engine rises, the less flow rate of bypass air passing through the bypass air passage should be supplied.

It is conceivable that, as the means for controlling the amount of bypass air passing through the bypass air passage, there may be provided a wax-type bypass air valve wherein the openings are varied in accordance with the engine coolant temperature.

However, such a disadvantage is presented in that case that, when the bypass air valve of the aforesaid wax-type is adapted to be driven in accordance with the engine coolant temperature, the openings of the bypass air passage become small excessively early, whereby the flow rate of bypass air necessary for the engine cannot be supplied, thus lowering the drivability.

The fuel sprayed from the fuel injection valve in the above-described fuel injection carburetor, depending on the throttle openings, flows down, going over an opening forward end at the upstream side of the throttle valve, or flows down only through the opening forward end on the downstream side of the throttle valve, and moves to the right and left in the throttle bore, whereby a dispersion may occur in the amount of distribution of fuel supplied to respective cylinders of a multi-cylinder engine.

There has been presented such disadvantages that, even if a bypass air passage is provided in the above-described fuel injection carburetor, the mixing becomes unstable because the air-fuel mixture in the intake passage as being a main passage and the bypass air flowing out of the bypass air passage meet with each other not at a constant ratio. Further, a high dispersion occurs in the air-fuel ratio in the respective cylinders in the multi-cylinder engine, whereby the engine output is adversely affected, the idle operation of the engine becomes unstable, and further, the response of the engine output to the variation in the openings of the throttle valve, i.e. the transient response, is unsatisfactory.

Further, in the fuel injection carburetor provided with the above-described idling bypass air passage, a bypass air passage for the idle adjustment having small diameter is provided in the intake passage, bypassing the throttle valve, from a position upstream to a position downstream of the throttle valve, in addition to the aforesaid idling bypass air passage, whereby the air flow rate in the bypass air passage controlled by the bypass air valve of the aforesaid wax-type is corrected by this bypass air passage for the idle adjustment.

In this case, an outlet of the bypass air passage for the idle adjustment should be opened at a position upstream of the intake manifold and downstream of the throttle valve, so that the outlet should necessarily be opened at a position downstream of the throttle valve and adjacent to the throttle valve in the intake passage of the throttle body.

However, the fuel injected through the fuel injection valve of the fuel injection carburetor is not perfectly atomized throughout all of the operating conditions of the engine, part of the fuel adheres to the inner wall of the intake passage of the throttle body, flows down together with the intake air stream, reaches the outlet of the bypass air passage for the idle adjustment provided adjacent the downstream side of the throttle valve, or the fuel injected through the fuel injection valve adheres directly to the aforesaid outlet and may intrude into the bypass air passage for the idle adjustment therefrom.

Such disadvantages have been presented that, when the liquid fuel adheres to the outlet of the bypass air passage for the idle adjustment or the liquid fuel intrudes into the bypass air passage as described above, the pressure in the vicinity of the outlet of the bypass air passage becomes unstable, with the result that the flow rate of air passing through the bypass air passage becomes unstable, and further, the liquid fuel, which has intruded into the bypass air passage, flows out into the throttle bore, whereby the idling operation of the engine becomes unstable.

SUMMARY OF THE INVENTION

An object of the present invention is to provide a fuel injection carburetor wherein, even if an outlet of a bypass air passage for the idle adjustment is provided adjacent a portion downstream of a throttle valve, the adhesion of fuel to the outlet or the intrusion of fuel into the bypass air passage for the idle adjustment through the outlet can be avoided, so that the idling operation of the engine can be stabilized.

Another object of the present invention is to provide a fuel injection carburetor wherein, even when an air bypass valve of a wax-type is driven by an engine coolant, a sufficient flow rate of bypass air is secured, so that lowered drivability of the engine can be avoided.

A further object of the present invention is to provide a fuel injection carburetor wherein a sufficient flowrate of bypass air can be secured and the mixing of fuel with bypass air is facilitated.

To the above end, the present invention contemplates that, in a fuel injection carburetor in an internal combustion engine, comprising a fuel injection valve provided at a position upstream of a throttle valve and directed to the throttle valve, an idling bypass air passage, an inlet and an outlet of which are opened at a position upstream and a position downstream of the throttle valve in a throttle bore, respectively, bypassing the throttle valve, and a bypass air passage for the idle adjustment to correct air flow rate in the idling bypass air passage, the range of fuel spray angle of the fuel injection valve is determined such that the fuel injection valve is disposed in such a manner that a position on the surface of the throttle valve, to which the sprayed fuel reaches, is always located at an opening forward end in the downstream direction of the throttle valve rather than an opening forward end in the upstream direction within the total throttle opening of the throttle valve from the full closing to the full opening, and an outlet of the bypass air passage for the idle adjustment is provided on an inner wall on the side of the opening forward end in the upstream direction of the throttle valve.

To the above end, the present invention contemplates that, in a fuel injection carburetor in an internal combustion engine, comprising a fuel injection valve provided at a position upstream of a throttle valve and directed to the throttle valve secured to an intake passage of a throttle body and an idling bypass air passage, an inlet and an outlet of which are opened at a position upstream and a position downstream of the throttle valve in the intake passage, bypassing the throttle valve, the range of fuel spray angle of the fuel injection valve is determined such that the fuel injection valve is disposed in such a manner that a position on the surface of the throttle valve, to which the sprayed fuel reaches, is always located at an opening forward end in the downstream direction of the throttle valve rather than an opening forward end in the upstream direction within the total throttle opening of the throttle valve from the full closing to the full opening, and there are provided a bypass air valve of a wax-type provided in the intermediate portion of the idling bypass air passage and in which the higher the temperature rises, the less the flowing area of the bypass air passage is made, and a hot water passage for circulating the engine coolant from a position adjacent the opening forward end in the downstream direction of the throttle valve and through a wax portion of the bypass air valve of the wax type.

To the above end, the present invention contemplates that the outlet of the idling bypass air passage is provided on an inner wall of the opening forward end in the upstream direction of the throttle valve in the intake passage.

In this invention, most of the fuel injected through the fuel injection valve flows down on an inner wall of the throttle bore on the side opposite to the outlet of the bypass air passage for the idle adjustment, the injected fuel or the fuel, which has adhered to the inner wall of the throttle bore and turned into liquid form, does not adhere to the aforesaid outlet.

In this invention, most of the fuel injected from the fuel injection valve flows down on the inner wall of the intake passage on the side of the outlet of the idling bypass air passage, where the fuel is heated and atomized by hot water passing through the hot water passage.

Furthermore, the air bypass valve of the wax type is actuated slightly behind the elevation of the engine coolant temperature by the hot water slightly lowered in temperature after heating and atomizing the fuel injected through the fuel injection valve, i.e. the hot water slightly lower in temperature than the engine coolant and controls the flowrate of the bypass air in accordance therewith.

Furthermore, in this invention, the fuel injected through the fuel injection valve flows down on the inner wall of the intake passage on the side of the idling bypass air passage, so that the mixing of the fuel with the bypass air is facilitataed.

DETAILED DESCRIPTION OF THE PREFERRED EMBODIMENTS

Description will hereunder be given of the embodiments of the present invention with reference to the drawings.

Figure 1:
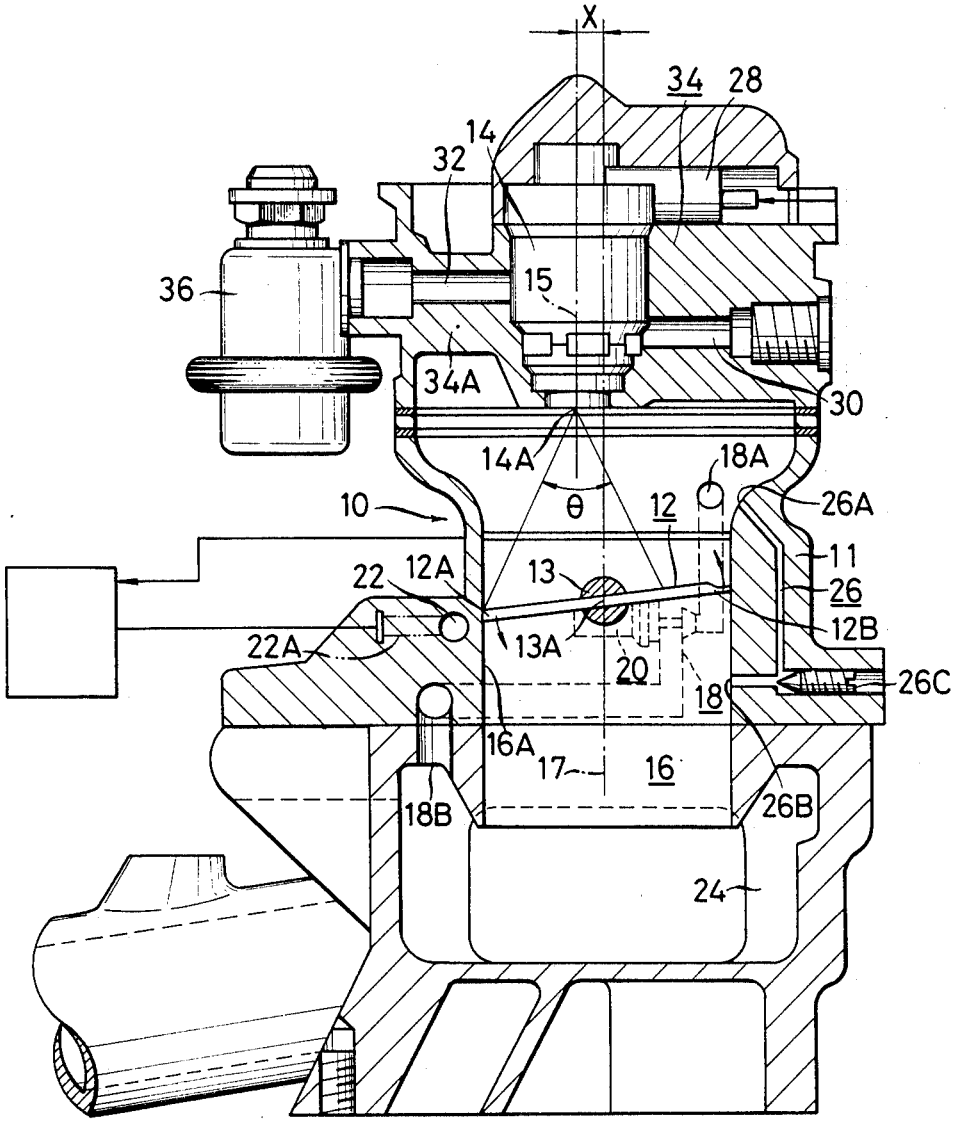
FIG. 1 is a sectional view showing a first embodiment of the fuel injection carburetor according to the present invention.
Figure 2:
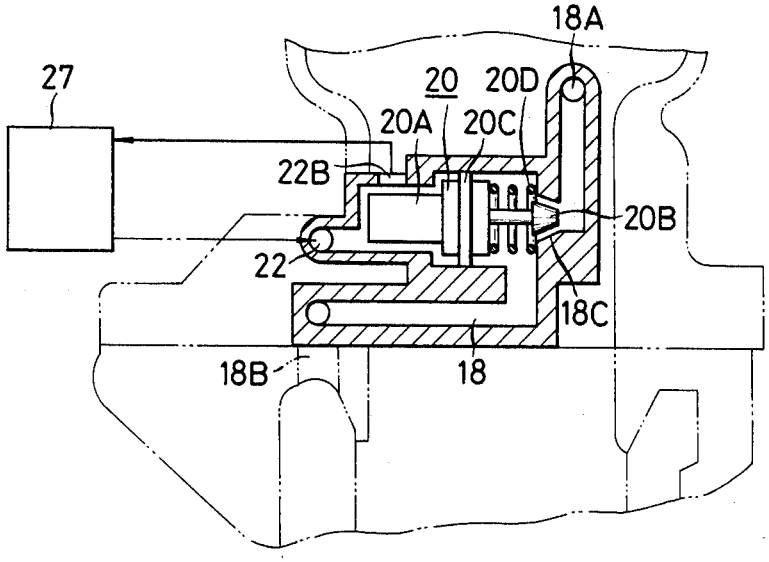
FIG. 2 is a sectional view with a partial block diagram, showing the essential portions of the above embodiment.

As shown in FIGS. 1 and 2, according to this embodiment, in a fuel injection carburetor 10 in an internal combustion engine, comprising a fuel injection valve 14 provided at a position upstream of a throttle valve 12 secured to a throttle body 11 and directed to the throttle valve 12, and an idling bypass air passage 18, an inlet 18A and an outlet 18B are opened at a position upstream and a position downstream of the throttle valve 12 in an intake passage 16, bypassing the throttle valve 12, the range of fuel spray angle of the fuel injection valve 14 is disposed in such a manner that a position on the surface of the throttle valve 12, to which the sprayed fuel reaches, is always located at an opening forward end in the downstream direction 12A of the throttle valve 12 rather than an opening forward end in the upstream direction 12B within the total throttle openings, and there are provided a bypass air valve 20 of a wax-type provided in the intermediate portion of the idling bypass air passage 18 and in which the higher the temperature rises, the less the flowing area of the idling bypass air passage 18 is made, and a hot water passage 22 for circulating the engine coolant from a position adjacent the opening forward end in the downstream direction 12A of the throttle valve 12 in the throttle body 11 and through a wax portion 20A of the bypass air valve 20 of the wax type.

The outlet 18B of the idling bypass air passage 18 is provided on the inner wall on the side of the opening forward end in the downstream direction 12A of the throttle valve 12 in the intake passage 16 on the side of an intake manifold 24 immediately after the throttle body 11.

In the fuel injection valve 14, the center line of the fuel spray angle thereof is disposed in a manner to be in parallel to the center axis 17 of a throttle bore 16A forming a part of the intake passage 16 in the throttle body 11 and be offset toward the opening forward end in the downstream direction 12A of the throttle valve 12, and the fuel spray angle $\theta$ covers the opening forward end in the downstream direction 12A rather than the opening forward end in the upstream direction 12B of the throttle valve 12 within the range of the throttle openings.

Furthermore, the fuel spray angle $\theta$ of the fuel injection valve 14 is determined such that the limit of the fuel spray angle on the side of the opening forward end in the downstream direction 12A substantially coincides with the opening forward end in the downstream direction 12A in the state of full closing.

The idling bypass air passage 18 is intended for stably supplying air during idling of the engine to stabilize the idling operation, however, it is difficult to effect fine adjustment of the air flow rate. In consequence, the air flowrate in the idling bypass air passage 18 is corrected by a bypass air passage for the idle adjustment 26 provided separately from the idling bypass air passage 18.

An inlet 26A of this bypass air passage for the idle adjustment 26 is opened in a portion of the intake passage 16 at the upstream side of the throttle valve 12, and an outlet 26B is opened in a portion of the throttle bore 16A immediately before the throttle bore 16A is connected to the intake manifold 24, penetrating through the throttle body 11.

In the drawings, designated at 20B is a valve body driven by the wax portion 20A to contact or be separated from a valve seat 18C on the side of the idling bypass air passage 18, 20C an O-ring for sealing a space formed between the idling bypass air passage 18 and the hot water passage 22, 20D a return spring, 22A an inlet of the hot water passage 22, 22B an outlet thereof, 26C an idle adjustment screw for converting an area of passage of the bypass air passage 26 to adjust an air flowrate, 27 an engine coolant jacket, 28 a wiring connector for controlling the fuel injection valve 14, 30 a fuel supply passage, 32 a fuel return passage, 34 a support bar for supporting the fuel injection valve 14, and 36 a pressure regulator, respectively.

In this embodiment, the fuel spray angle $\theta$ is set at 50° when the inner diameter of the throttle bore 16A around the throttle valve 12 is 45 mm, a distance in the direction of the axis of the throttle bore 16A from the rocking center shaft 13A of the throttle shaft 13 to a fuel spray center 14A at the foward end of the fuel injection valve 14 is 35 mm, and an offset value X of the center line 15 of the spray angle of the fuel injection valve 14 from the center axis 17 of the throttle bore 16A is 5 mm.

In this embodiment, the center line 15 of the spray angle of the fuel injection valve 14 is offset from the center axis 17 of the throttle bore 16A toward the opening forward end in the downstream direction 12A of the throttle valve 12, and the range of the fuel spray angle of the fuel injection valve 14 is determined such that the fuel injection valve 14 is disposed in such a manner that a position on the surface of the throttle valve 12, to which the sprayed fuel reaches, is always located at an opening forward end in the downstream direction 12A of the throttle valve 12 rather than an opening forward end in the upstream direction 12B within the total throttle opening of the throttle valve 12 from the full closing to the full opening. In consequence, the fuel sprayed through the fuel injection valve 14 is always caused to flow down from the side of the opening forward end in the downstream direction 12A of the throttle valve 12 regardless of the openings of the throttle valve 12, and none or little of the sprayed fuel flows down on the inner wall of the throttle bore 16 from the side of the opening forward end in the upstream direction 12B in the throttle bore 16A as shown to the right in the drawing.

In consequence, most of the fuel sprayed through the fuel injection valve 14 is heated in the throttle body 11 by the heat of the engine coolant from the hot water passage 22 passing by the opening forward end in the downstream direction 12A of the throttle valve 12, so that the atomization of the sprayed fuel is facilitated.

The hot water, which has heated the sprayed fuel in the vicinity of the opening forward end in the downstream direction 12A of the throttle valve 12, is slightly lowered in temperature by the heat exchange undergone with the aforesaid sprayed fuel, and thereafter, reached the wax portion 20A of the bypass air valve 20 of the wax-type, where the hot water heats the wax portion 20A.

This bypass air valve 20 of the wax-type, in which the valve body 20B is driven by the heat of the hot water passing through the hot water passage 22, controls an air flow rate in the idling bypass air passage 18, i.e. a bypass air flow rate in such a manner that the higher the temperature of the hot water, the less the bypass air flow rate becomes. However, the temperature of the hot water passing through the hot water passage 22 and reaching the wax portion 20A, being slightly cooled as described above, comes to be slightly lower than the temperature of the engine coolant.

In consequence, a bypass air flowrate in the bypass air passage 18, controlled by the bypass air valve 20 of the wax-type is controlled in such a manner that the bypass air flow rate is decreased slightly behind the elevation in temperature of the engine coolant, whereby the bypass air flow rate passing the bypass air passage 18 is secured in a sufficient quantity, so that the drivability can avoid being lowered.

Furthermore, the outlet 18B of the idling bypass air passage 18 is located on the side of the opening forward end in the downstream direction 12A of the throttle valve 12 in the intake passage 16, so that the mixing of the bypass air with the sprayed fuel caused to flow down only through the opening forward end in the downstream direction 12A can be satisfactory all the time regardless of the throttle openings.

In consequence, the idling operation of the engine becomes stabilized.

Furthermore, the fuel spray angle $\theta$ of the fuel injection valve 14 substantially coincides with the opening forward end in the downstream direction 12A in the state of the full closing, whereby the range of the sprayed fuel reaching the upper surface of the throttle valve 12 has a smaller diameter than the inner diameter of the throttle bore 16A.

In consequence, the sprayed fuel never reaches the vicinity of an intersection between the throttle bore 16A and the throttle shaft 13.

Since the intake air flow rate is normally slow in the vicinity of the intersection between the throttle shaft 13 and the throttle bore 16A, it may be thought that the fuel sprayed to the vicinity of the intersection passes through a gap between the throttle valve 12 and the throttle bore 16A without being disturbed by the intake air stream, and reaches the inner wall of the throttle bore 16A on the side of the opening forward end in the upstream direction 12B or the outlet 26B of the bypass air passage for the idle adjustment 26. However, in the above embodiment, all amount of the sprayed fuel, flowing on the upper surface of the throttle valve 12, flows down from the side of the opening forward end in the downstream direction 12A, so that little or no sprayed fuel adheres to the inner wall on the side of the opening forward end in the upstream direction 12B of the throttle bore 16A or the outlet 26B.

In consequence, in this embodiment, the adhesion of the sprayed fuel to the outlet 26B provided in the throttle bore 16A of the bypass air passage 26 or the flow-in of the sprayed fuel into the bypass air passage 26 is almost eliminated or suppressed to a considerable extent. In consequence, the pressure in the throttle bore 16A in the vicinity of the outlet 26B of the bypass air passage 26 is stabilized, so that the air flow rate passing through the bypass air passage 26 can be stabilized and the idling operation of the engine can be prevented from becoming instable by the drip-down of the fuel, which has intruded into the bypass air passage 26, into the throttle bore 16A and so on.

In the above embodiment, the center line 15 of the spray angle of the fuel injection valve 14, i.e. the center axis of the fuel injection valve 14 is disposed in parallel to the center axis 17 of the throttle bore 16A and offset toward the opening forward end in the downstream direction 12A of the throttle valve 12, however, the scope of application of the present invention need not necessarily be limited to this, and such an arrangement may be adopted that the range of the fuel spray angle of the fuel injection valve 14 is determined such that a position on the surface of the throttle valve 12, to which the sprayed fuel reaches, is always located at an opening forward end in the downstream direction 12A rather than an opening forward end in the upstream direction 12B within the total throttle opening of the throttle valve 12 from the full closing to the full opening.

In consequence, any arrangement may be adopted in which only if the fuel spray center 14A of the fuel injection valve 14 is offset from the center axis 17 of the throttle bore 16A passing through the rocking center axis 13A of the throttle valve 12 to a position closer to the opening forward end in the downstream direction 12A, and the range of the fuel spray angle of the fuel injection valve 14 covers the opening forward end in the downstream direction 12A, and the range of the fuel spray angle of the fuel injection valve 14 covers the opening forward end in the downstream direction 12A rather than the opening forward end in the upstream direction 12B of the throttle valve 12 from the full closing to the full opening.

Figure 3:
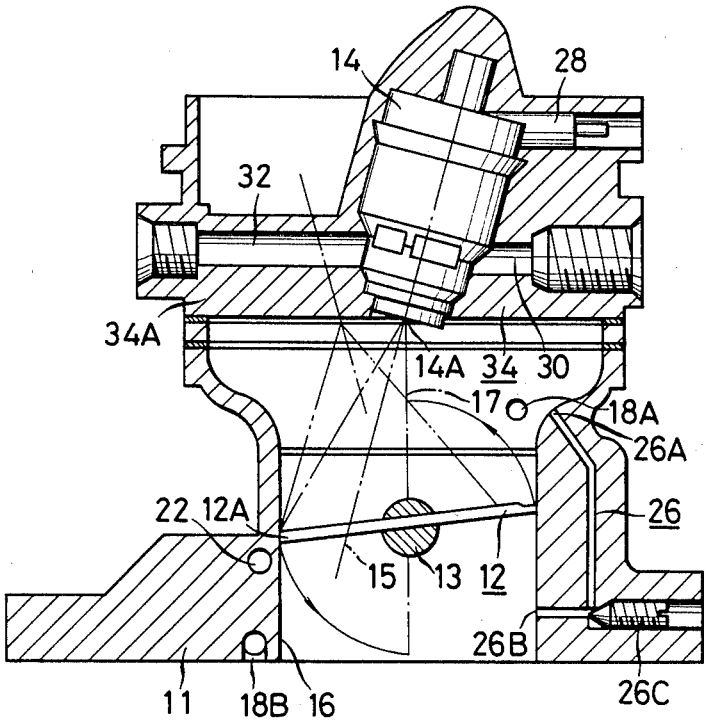
FIG. 3 is a sectional view showing a second embodiment of the present invention.

In consequence, as shown in FIG. 3 for example, the center line 15 of the fuel injection valve 14 may be inclined with respect to the center axis 17 of the throttle bore 16A.

In this embodiment, the length of a portion 34A of the support bar 34 supporting the fuel injection valve 14 on the side of the opening forward end in the downstream direction 12A of the throttle valve 12 may be made longer than that which is shown in FIG. 1, whereby the area of the intake passage on the side of the opening forward end in the downstream direction 12A of the throttle valve 12 is expanded, so that the intake air stream can be strongly led toward the opening forward end in the downstream direction 12A, so that the flow-down of the sprayed fuel toward the opening forward end in the upstream direction 12B can be further suppressed.

Furthermore, in the above embodiment, the center line 15 of the spray angle of the fuel injection valve 14 is inclined with respect to the center axis 17 of the throttle bore 16A in a clockwise direction in FIG. 2, however, the scope of application of the present invention need not necessarily be limited to this, and the center line 15 may be inclined in a direction opposite to the above, i.e. in a counterclockwise direction, whereby the range of spray may be indicated by two-dot chain lines in FIG. 3. In this case, a portion of the fuel injection valve 14 can be projected outwardly from the throttle bore 16, so that the area of the intake air flow in the vicinity of the fuel injection valve 14 in the throttle bore 16A can be advantageously expanded.

Further, in the above embodiments, the limit of the spray angle of the fuel injection valve 14 on the side of the opening forward end in the downstream direction 12A substantially coincides with the opening forward end in the downstream direction 12A of the throttle valve 12 in the fully closed state, however, the scope of application of the present invention need not necessarily be limited to this, and the limit of the spray angle on the side of the opening forward end in the downstream direction 12A may reach a position outwardly of the opening forward end in the downstream direction 12A of the throttle valve 12, so that part of the sprayed fuel may impinge on the inner wall of the throttle bore 16A.

In this case, part of the fuel sprayed through the fuel injection valve 14 adheres to the inner wall of the throttle bore 16A, however, the position of adhesion is in the vicinity of the opening forward end in the downstream direction 12A of the throttle valve 12, where air flow velocity is high, whereby the amount of adhesion is small due to the intake air stream flowing at high velocity and, even if the fuel adheres, the fuel is atomized at once, so that the adverse influence is limited.

Additionally, in the above embodiment, the outlet 18B of the idling bypass air passage 18 is formed in the intake manifold 22 disposed immediately after the throttle body 11, however, the scope of application of the present invention need not necessarily be limited to this, and the outlet 18B may be formed in the throttle body 11.

What is claimed is:

1. A fuel injection carburetor in an internal combustion engine, comprising: a fuel injection valve provided at a position upstream of a throttle valve and directed to the throttle valve; an idling bypass air passage, an inlet and an outlet of which are opened at a position upstream and a position downstream of the throttle valve in a throttle bore, respectively, bypassing the throttle valve; and a bypass air passage for the idle adjustment to correct air flow rate in the idling bypass air passage; wherein the range of fuel spray angle of said fuel injection valve is determined such that said fuel injection valve is disposed in such a manner that a position on the surface of the throttle valve, to which the sprayed fuel reaches, is always located at an opening forward end in the downstream direction of the throttle valve rather than an opening forward end in the upstream direction within the total throttle opening of the throttle valve from the full closing to the full opening, and an outlet of the bypass air passage for the idle adjustment is provided on an inner wall on the side of the opening forward end in the upstream direction of the throttle valve.

2. A fuel injection carburetor in an internal combustion engine as set forth in claim 1, wherein an outlet of said idling bypass air passage is provided on the inner wall of an intake passage on the side of said opening forward end in the downstream direction of said throttle valve.

3. A fuel injection carburetor in an internal combustion engine as set forth in claim 1, wherein the center line of the spray angle of said fuel injection valve is offset from the center axis of the throttle bore toward the opening forward end in the downstream direction of the throttle valve.

4. A fuel injection carburetor in an internal combustion engine as set forth in claim 2, wherein the center line of the spray angle of said fuel injection valve is offset from the center axis of the throttle bore toward the opening forward end in the downstream direction of the throttle valve.

5. A fuel injection carburetor in an internal combustion engine as set forth in claim 1, wherein the center line of the spray angle of said fuel injection valve is inclined with respect to the center axis of the throttle bore.

6. A fuel injection carburetor in an internal combustion engine as set forth in claim 2, wherein the center line of the spray angle of said fuel injection valve is inclined with respect to the center axis of the throttle bore.

7. A fuel injection carburetor in an internal combustion engine as set forth in claim 3, wherein the center line of the spray angle of said fuel injection valve is inclined with respect to the center axis of the throttle bore.

8. A fuel injection carburetor in an internal combustion engine as set forth in claim 4, wherein the center line of the spray angle of said fuel injection valve is inclined with respect to the center axis of the throttle bore.

9. A fuel injection carburetor in an internal combustion engine as set forth in claim 5, wherein said fuel injection valve is disposed such that the center line of the spray angle passes through the opening forward end in the downstream direction of said throttle valve rather than the center axis of said throttle bore.

10. A fuel injection carburetor in an internal combustion engine as set forth in claim 6, wherein said fuel injection vlve is disposed such that the center line of the spray angle passes through the opening forward end in the downstream direction of said throttle valve rather than the center axis of said throttle bore.

11. A fuel injection carburetor in an internal combustion engine as set forth in claim 7, wherein said fuel injection valve is disposed such that the center line of the spray angle passes through the opening forward end in the downstream direction of said throttle valve rather than the center axis of said throttle bore.

12. A fuel injection carburetor in an internal combustion engine as set forth in claim 8, wherein said fuel injection valve is disposed such that the center line of the spray angle passes through the opening forward end in the downstream direction of said throttle valve rather than the center axis of said throttle bore.

13. A fuel injection carburetor in an internal combustion engine, comprising: a fuel injection valve provided at a position upstream of a throttle valve and directed to the throttle valve; an idling bypass air passage, an inlet and an outlet of which are opened at a position upstream and a position downstream of the throttle valve in a throttle bore, respectively, bypassing the throttle valve; and a bypass air passage for the idle adjustment to correct air flow rate in the idling bypass air passsage; wherein the range of fuel spray angle of said fuel injection valve is determined such that said fuel injection valve is disposed in such a manner that a position on the surface of the throttle valve, to which the sprayed fuel reaches, is always located at an opening forward end in the downstream direction of the throttle valve rather than an opening forward end in the upstream direction within the total throttle opening of the throttle valve from the full closing to the full opening, and there are provided a bypass air valve of a wax-type provided in the intermediate portion of the idling bypass air passage and in which the higher the temperature rises, the less the flowing area of the bypass air passage is made, and a hot water passage for circulating the engine coolant from a position adjacent the opening forward end in the downstream direction of the throttle valve and through a wax portion of the bypass air valve of the wax type.

14. A fuel injection carburetor in an internal combustion engine as set forth in claim 13, wherein the outlet of said idling bypass air passage is provided on an inner wall of the intake passage on the side of the opening forward end in the upstream direction of said throttle valve.

15. A fuel injection carburetor in an internal combustion engine as set forth in claim 13, wherein the outlet of the bypass air passage for the idle adjustment to correct an air flow rate in the idling bypass air passage is provided on an inner wall of the intake passage on the side of the opening forward end in the upstream direction of said throttle valve.

16. A fuel injection carburetor in an internal combustion engine as set forth in claim 14, wherein the outlet of the bypass air passage for the idle adjustment to correct an air flowrate in the idling bypass air passage is provided on an inner wall of the intake passage on the side of the opening forward end in the upstream direction of said throttle valve.

17. A fuel injection carburetor in an internal combustion engine as set forth in claim 13, wherein the center line of the spray angle of said fuel injection valve is offset from the center axis of the throttle bore toward the opening forward end in the downstream direction of the throttle valve.

18. A fuel injection carburetor in an internal combustion engine as set forth in claim 14, wherein the center line of the spray angle of said fuel injection valve is offset from the center axis of the throttle bore toward the opening forward end in the downstream direction of the throttle valve.

19. A fuel injection carburetor in an internal combustion engine as set forth in claim 15, wherein the center line of the spray angle of said fuel injection valve is offset from the center axis of the throttle bore toward the opening forward end in the downstream direction of the throttle valve.

20. A fuel injection carburetor in an internal combustion engine as set forth in claim 16, wherein the center line of the spray angle of said fuel injection valve is offset from the center axis of the throttle bore toward the opening forward end in the downstream direction of the throttle valve.

21. A fuel injection carburetor in an internal combustion engine as set forth in claim 13, wherein the center line of the spray angle of said fuel injection valve is inclined with respect to the center axis of the throttle bore.

22. A fuel injection carburetor in an internal combustion engine as set forth in claim 14, wherein the center line of the spray angle of said fuel injection valve is inclined with respect to the center axis of the throttle bore.

23. A fuel injection carburetor in an internal combustion engine as set forth in claim 15, wherein the center line of the spray angle of said fuel injection valve is inclined with respect to the center axis of the throttle bore.

24. A fuel injection carburetor in an internal combustion engine as set forth in claim 16, wherein the center line of the spray angle of said fuel injection valve is inclined with respect to the center axis of the throttle bore.

* * * * *